US007637399B2

(12) United States Patent
Marroncles et al.

(10) Patent No.: US 7,637,399 B2
(45) Date of Patent: Dec. 29, 2009

(54) SPRAY DISCHARGE CAP FOR A SPRAYER HAVING A VALVE

(75) Inventors: Alain Marroncles, Saint Maur des Fosses (FR); Herve Bodet, Verdun (FR)

(73) Assignee: Lindal Ventil GmbH, Bad Oldesloe (DE)

( * ) Notice: Subject to any disclaimer, the term of this patent is extended or adjusted under 35 U.S.C. 154(b) by 486 days.

(21) Appl. No.: 11/087,410

(22) Filed: Mar. 23, 2005

(65) Prior Publication Data

US 2005/0230436 A1 Oct. 20, 2005

(30) Foreign Application Priority Data

Apr. 20, 2004 (EP) ..... 04009248

(51) Int. Cl.
*B65D 37/00* (2006.01)

(52) U.S. Cl. ..... 222/402.13; 222/402.21

(58) Field of Classification Search ..... 222/380, 222/518, 402.13, 402.15, 1, 402.21, 402.22, 222/402.23

See application file for complete search history.

(56) References Cited

U.S. PATENT DOCUMENTS

| | | | | |
|---|---|---|---|---|
| 3,249,267 | A * | 5/1966 | Carmelo, Jr. et al. | 222/402.13 |
| 3,584,789 | A | 6/1971 | Traynor | 239/117 |
| 3,734,125 | A | 5/1973 | Bruce et al. | 137/495 |
| 5,096,098 | A * | 3/1992 | Garcia | 222/402.13 |
| 5,205,443 | A * | 4/1993 | Inui et al. | 222/402.13 |
| 5,305,930 | A * | 4/1994 | De Laforcade | 222/402.13 |
| 5,429,275 | A * | 7/1995 | Katz | 222/108 |
| 5,624,055 | A | 4/1997 | Clanet et al. | 222/135 |
| 6,837,396 | B2 * | 1/2005 | Jaworski et al. | 222/1 |
| 6,966,465 | B2 * | 11/2005 | Kang, III | 222/380 |
| 2005/0103811 | A1 * | 5/2005 | Heukamp | 222/402.13 |

FOREIGN PATENT DOCUMENTS

| | | |
|---|---|---|
| EP | 1295812 | 9/2001 |
| EP | 1295812 A1 | 3/2003 |
| WO | WO 2004/000066 * | 12/2003 |

* cited by examiner

*Primary Examiner*—J. Casimer Jacyna
(74) *Attorney, Agent, or Firm*—Vidas, Arrett & Steinkraus, P.A.

(57) ABSTRACT

A spray discharge cap for a sprayer having a valve, comprising: a spray release top attachment including a retainer ring and an actuation element which is hinged to said retainer ring, an outlet tube having an outlet opening and an inlet opening that is connected to said valve, a piston element movably disposed in said outlet tube which is in a position closing said outlet opening if said actuation element is not depressed, and which is movable inside said outlet tube via a dog mechanism, wherein said dog mechanism interacts with said actuation element in such a way that if said actuation element is depressed said piston element is in a position releasing said outlet opening.

11 Claims, 3 Drawing Sheets

SPRAY DISCHARGE CAP FOR A SPRAYER HAVING A VALVE

CROSS-REFERENCE TO RELATED APPLICATIONS

Figure 1:
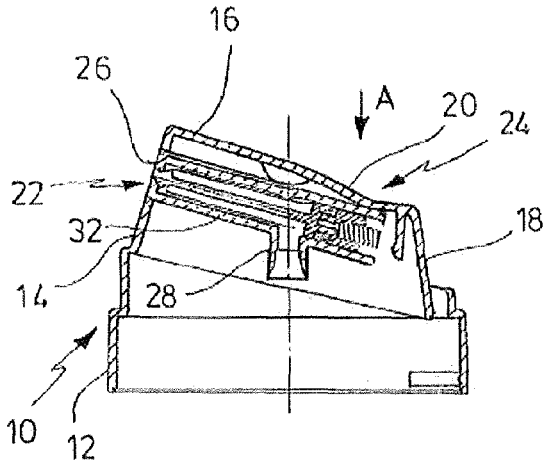

Not applicable.

STATEMENT REGARDING FEDERALLY SPONSORED RESEARCH

Not applicable.

BACKGROUND OF THE INVENTION

It is particularly when spray discharge caps are used to eject a foam, gel or the like that the problem of post-foaming occurs which involves the continued formation of foam at the outlet opening after the valve is closed. In the course of time, such foam which has formed can paste up the outlet opening and even tends to close it completely. In addition, the residues which mostly are dried out in the area of the outlet opening will not look very attractive. Therefore, as a rule, the spray discharge caps are covered by a separate closure cap. Although this does not prevent the formation of residues at the outlet opening the bad optical impression will certainly no longer occur.

It is the object of the invention to provide a spray discharge cap which, using simple means, efficiently prevents the ejected medium from post-foaming at the outlet opening and prohibits residues from being formed thereon.

BRIEF SUMMARY OF THE INVENTION

The inventive spray discharge cap has a spray release top attachment which includes a retainer ring and an actuation element which is hinged thereto. The spray release top attachment, along with the retainer ring, is placed onto the sprayer and gets latched on the valve disk, for example. The inventive spray discharge cap further has an outlet tube with an outlet opening, and an inlet opening which is connected to the valve. The pressurized medium is re-routed from the spray container to the outlet opening through the outlet tube. The inventive spray discharge cap further has a piston element which is movably disposed in the outlet tube. The piston element has a position closing said outlet opening and is further provided with a dog mechanism by means of which the piston element is adapted to be moved within the outlet tube. The dog mechanism interacts with the actuation element to move the piston out of its position closing the outlet opening if the valve is actuated. The piston will close the outlet opening in the non-actuated position. Hence, in the inventive spray discharge cap, the piston element is solely moved out of the outlet opening if the actuation element is depressed and a medium is ejected. At this stage, the piston element prevents a post-foaming effect because it closes the outlet from inside.

In a preferred aspect, the actuation element has a prolongation which, in a depressed position, bears against the outlet tube and forces it to a position opening the valve. The force necessary to open the spray container valve is applied by the actuation element to the exit tube via the prolongation which preferably is of a disk-like shape.

The dog mechanism of the piston suitably has at least one pin member which projects from a recess or breakthrough in the outlet tube. It is preferred to move the pin member by a prolongation of the actuation element facing the outlet tube with the pin member being moved out of its position closing the outlet opening by means of the prolongation.

Preferably, the outlet opening has an inlet portion connected to the inlet opening which opens transversely into an outlet channel in the outlet tube with the outlet channel having a first portion connected to the outlet opening and a second portion the diameter of which is larger than that of the first portion. Preferably, the inlet portion is of a diameter smaller than that of the outlet channel.

The inlet portion opens into the outlet channel approximately between the first and second portions. In a preferred aspect, the outlet channel in the spray discharge cap is disposed such as to ascend towards the outlet opening in order that a medium which did not completely exit by an actuation of the valve can flow back.

The piston element suitably has a circumferential groove in which a sealing ring is disposed which seals the second portion of the outlet channel.

In an embodiment, the second portion of the outlet channel is suitably closed by a cap member with a spring member being preferably supported against the cap member and the rear wall of the piston element and forces the piston element to the position closing the outlet opening.

In another feasible aspect, the outlet tube is formed integrally with the retainer ring. In this aspect, the retainer ring preferably has a step which holds the outlet tube at one end and which also has the integrally formed actuation element hinged thereto. In a preferred aspect, it is possible to open the spray discharge cap via a hinge between the actuation element and top attachment.

Preferably, the actuation element has at least one wall portion with a slot-shaped recess which receives the dog mechanism of the piston and, via the wall portion, guides the piston in the outlet tube. Unlike in the spring-biased aspect, the actuation element guides the piston element to both its closing position and opened position in this aspect.

The dog mechanism of the piston has at least one projecting pin member which projects from the outlet tube near the free end thereof.

If desired, depending on the medium to be ejected, the outlet tube may have placed therein an insert which constitutes the outlet opening of the medium to be ejected.

Figure 2:
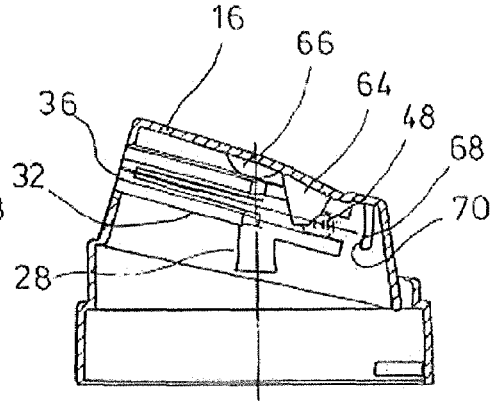
Figure 3:
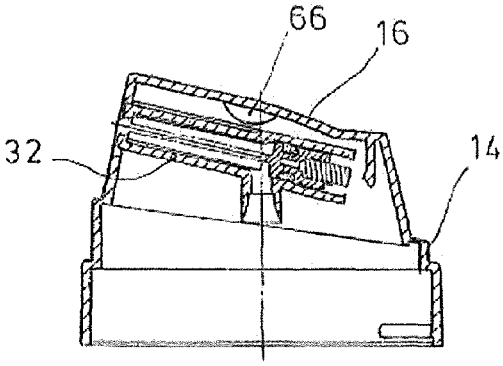
Figure 4A:
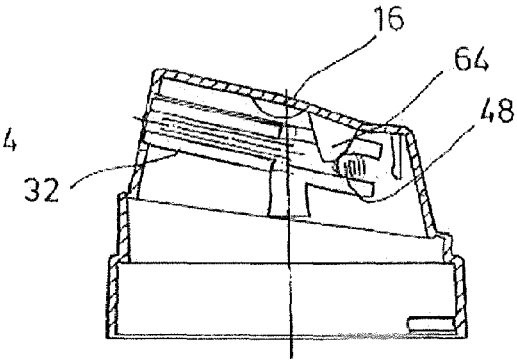
Figure 4B:
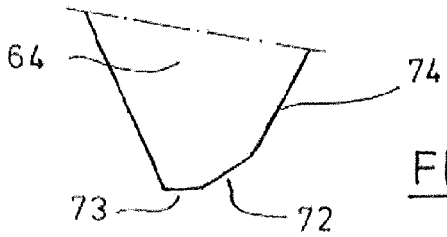
Figure 11:
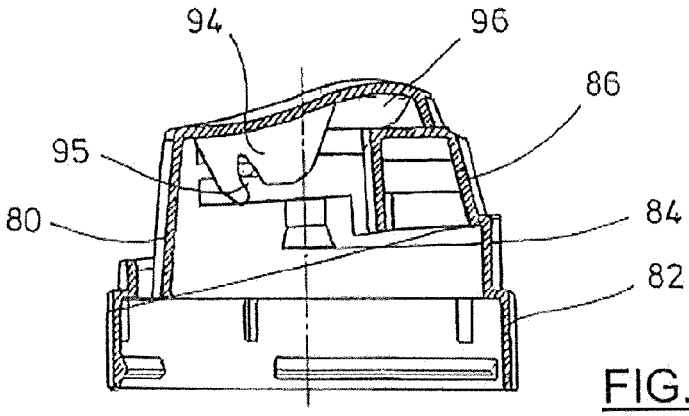

Two preferred embodiments will be described in more detail below with reference to the figures. In the figures:

FIG. 1 shows a first embodiment of the inventive spray discharge cap with the actuation element depressed, from a side, in a cross-section, FIG. 2 shows the spray discharge cap of FIG. 1 from a side in a cross-sectional view, FIG. 3 shows the spray discharge cap of FIG. 1 with the actuation element not depressed, in a cross-sectional view, FIG. 4*a* shows the spray discharge cap of FIG. 11 in a non-depressed position in a cross-sectional view, FIG. 4*b* shows the wall portion 64 of actuation element 16 in more detail.

Figure 5:
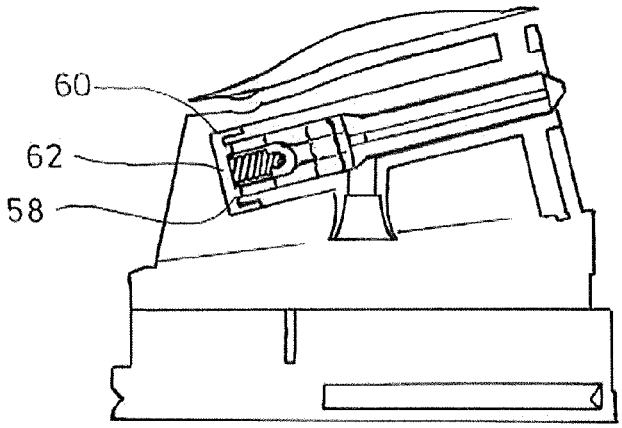
Figure 6:
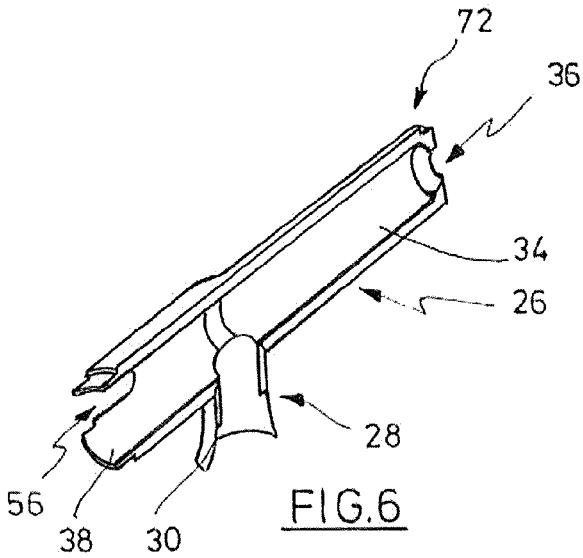
Figure 7:
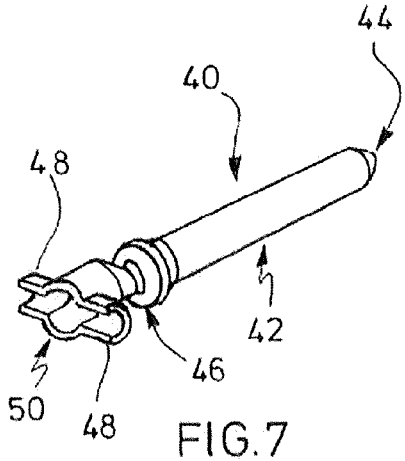
Figure 8:
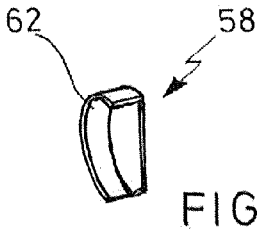
Figure 9:
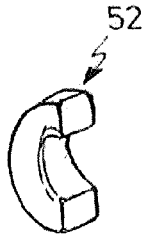
Figure 10:
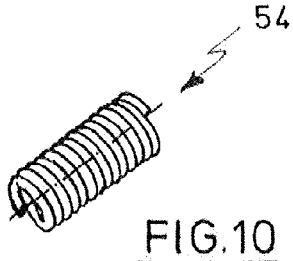
Figure 12:
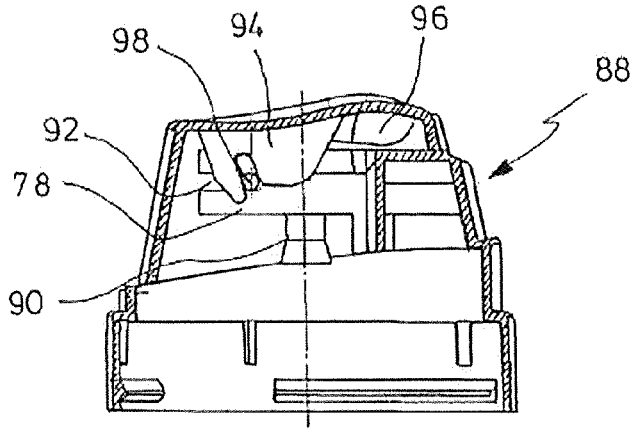
Figure 13:
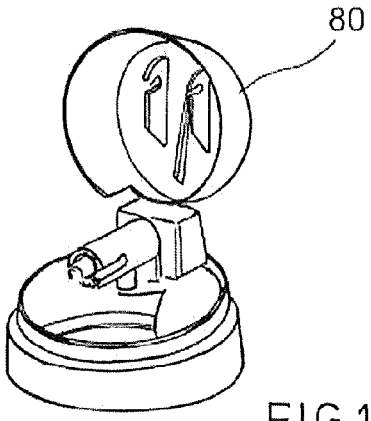
Figure 14:
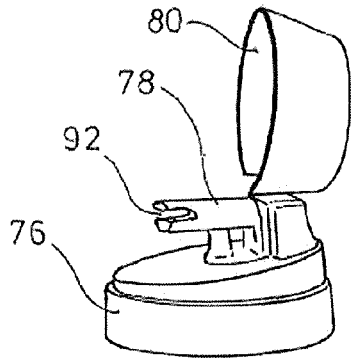

FIG. 5 shows the spray discharge cap of FIG. 1 in a non-depressed position, FIG. 6 shows the outlet tube as a section in a perspective view, FIG. 7 shows the piston element in a perspective view, FIG. 8 shows a half of the closure cap in a perspective view, FIG. 9 shows a half of a sealing ring in a perspective view, FIG. 10 shows the spring member in a perspective view, FIG. 11 shows a second aspect of the inventive spray discharge cap, when in a depressed position, in a cross-section, FIG. 12 shows the second aspect of the spray discharge cap, when in a non-depressed position, in a cross-section, FIG. 13 shows the spray discharge cap of FIG. 11 in the position of its manufacture in a perspective view, and FIG. 14 shows the spray discharge cap of FIG. 13 from a side in a perspective view.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated FIG. 1 shows a first aspect of the inventive spray discharge cap in a depressed position. A retainer ring 10 is composed of two ring portions 12 and 14 where the spray discharge cap is placed onto a sprayer by the ring portion 12 and gets latched on the valve disk, for example. The second ring portion 14 has a smaller diameter and an obliquely extending end edge. The height of the second ring portion 14 is largest in the area of the outlet opening and decreases continuously towards the diametrically opposed region.

An actuation element 16 is hinged to the second ring portion 14 in the area of the largest height and is forced down by depressing it in the direction of the arrow A. The actuation element 16 substantially is in the form of a cylindrical cap, with a circumferential wall 18 and an end wall 20. An opening 22 is provided in the circumferential wall 18. An indentation trough 24 is formed on the end wall 24.

The actuation element 16 has inserted therein an outlet tube 26 which will be described in detail with reference to FIG. 6. The outlet tube 26 has an inlet portion 28 with a conically expanding mounting area 30 for the valve. The inlet portion 28 opens into a transversely extending outlet channel 32. The outlet channel 32 has a first portion 34 which has its mouth in a conically tapering outlet opening 36, and a second portion 38 which has its end formed open. The inlet channel 28 opens into the outlet channel 32 between the first portion 34 and the second portion 38. The transition area between the first and the second portion is of a conical shape.

As can be clearly seen in FIGS. 1, 5, and 6 the inlet portion 28 opens into the outlet channel 32 such that the first portion 34, with the inlet portion 28, encloses an obtuse angle 34 and an acute angle with the second portion 38 in the Z-Y plane so that the outlet opening constitutes the highest point in an installed condition.

Disposed in the outlet tube 32 is a piston element 40. The piston element 40 is composed of a piston skirt 42 having a truncated tip 44 and a circumferential groove 46. At the end opposed to the tip 44, the piston element 40 has two lateral projections 48 which are in the shape of a cylinder half in the embodiment shown. The piston element 40 has a blind hole 50 in an axial direction between the projections 48.

A sealing ring 52 is placed onto the piston element in the recess 46. The sealing ring 52 is shown sectioned in FIG. 1. The blind hole 50 has inserted therein a coiled spring 54 which, when in a relaxed condition, extends beyond the piston end. When in an assembled condition, the piston element 40 is arranged in the outlet tube 32 with the piston tip 44 facing the outlet opening 36. The piston element is guided across the sealing ring 52 in the second portion 38 of the outlet tube and seals this portion from the medium. The pins 48 protrude laterally from a breakthrough 56 in the outlet tube. The second portion 38 of the outlet tube is closed by a cap 58. The cap has a circumferential border which can be provided with latching means for a connection to the outlet tube, for example. On its outer wall, at the end opposed to the outlet opening 36, the outlet tube has a circumference adapted to the inside diameter of the border 60. The cap 58 centrally has a hollow 62 to receive the spring 54 (cf. FIG. 5).

As can be clearly seen in FIG. 2 and FIG. 4*b* the actuation element 16 has two flat wall portions 64 projecting into the interior of the actuation element which extend into the interior of the actuation element in a sword shape. The wall portions 64 are of an approximately triangular shape with the wall facing away from the outlet opening 36 comprising three straight wall portions 72, 73, 74 which together enclose an angle. The wall portion 64 has a flat side disposed parallel to the outlet tube, the wall element side facing away from the outlet opening 36 bearing its wall portions 72 or 74 on the projection 48 of the piston element.

The actuation element 16 further has a central wall projection 66 which bears on the outlet tube 32 above the inlet portion 28.

The actuation element further has an arm 68 which extends into the interior and the free end of which has a protruding lug 70. The arm 68 projects from the actuation element 16 and holds the outlet tube 32 in the outlet opening 22. At its end provided with the outlet opening 36, the outlet tube 32 has a circumferential step 72 which bears on in the outlet opening 22 of the actuation element 16 and prevents the outlet tube 32 from being pushed out of the actuation element 16. The outlet tube 32 is laterally held by the wall portions 64 which stabilize the outlet tube 32 in a sideward direction.

FIGS. 3 and 4*a* show the inventive spray discharge cap in a non-actuated condition. The actuation element 16 substantially finishes to be flush with the second ring portion 14. The wall portion 64 holds its portion 72 against the pin 48 of the piston element whereas the wall portion 74 bears against the projection in the depressed position.

With the actuation member in the non-depressed position, the projection 66 does not bear, or bears with no force, against the outlet tube 32.

The actuation of the inventive spray discharge cap is done as follows:

A pressure onto the actuation element in the direction A or a pressure including a force component in the direction A onto the actuation element causes the actuation element to be pressed down. The outlet tube 32 is pressed down via the projection 66 and, in part, by the trough 24 of the actuation element 66. The outlet tube as depressed presses the sprayer discharge valve down and opens it. At the same time, the two wall portions 64 push the piston element back against the force of the spring 54 via the pin 48, thus causing the piston tip 44 to move out of the conical outlet opening 36. Thus, this releases the second portion 34 of the outlet channel 32, which enables the medium to exit through the inlet portion 28 and the first portion 34 of the outlet tube 32.

If no pressure is exerted onto the actuation element 16 it will return to its closed position. The valve of the sprayer is closed and no more medium will exit. The wall portion 64 moves along the pin 48 and comes to bear on the area of the wall portion 74; the spring 54 advances the piston element to the closing position. The outlet opening 36 is closed by the tip 44.

FIGS. 11 to 14 show a second aspect of the inventive spray discharge valve where FIG. 13 illustrates the position of the spray discharge valve in its position of manufacture. In this aspect, the retainer ring 76, the actuation element 78, and the outlet tube 80 are formed integrally. The retainer ring 76 is composed of two ring portions 82 and 84 with the ring portion 84 having an obliquely extending edge. The spray discharge cap is placed onto a sprayer by the first portion 82 of the retainer ring and is latched on the valve disk, for example. The second ring portion 84 has protruded therefrom a nearly rectangular step 86 to which the actuation element 80 is hinged. Centrally provided in the step 86 is the outlet opening 88 for the medium. The outlet opening 88 is joined by the outlet tube 78 which extends through the centre of the spray release cap. The outlet tube 78 has an inlet portion 90 which again is provided with a conically expanding mounting area for the valve of the spray release cap. The outlet tube 78 has lateral slots 92 at its end facing away from the outlet opening 88. The end of the outlet tube 78 that is opposed to the outlet opening 88 is open.

The actuation element 80 has three wall projections extending into the interior, two of which wall projections 94 are disposed laterally of the outlet tube 78 and the third wall projection 96 is centrally located above the outlet tube.

The wall projections 94 have a slot-shaped recess 95 which, in its length, is slightly inclined from the central longitudinal axis. The disk-shaped projections 94 are laterally positioned next to the outlet tube 78 and bear one side flat against it. The wall projection 96 bears against the outlet tube 78 in the depressed position, cf. FIG. 11, and transfers the force exerted onto the actuation element 80 to the outlet tube 78, which force will open the valve via the inlet portion 90.

The outlet tube 78 has inserted therein a piston element which can be formed, for example, like the piston element of the first embodiment. The piston element of the second embodiment also has lateral pins 98 which project from the slots 92, but are formed as round pins, in contrast to the previous embodiment. The pins 98 approximately have the diameter of the slot 95. With the piston element in the assembled condition, one pin 98 each is received into one of the slots 95.

The actuation of the inventive spray discharge cap is done as follows:

A pressure onto the actuation element 80 causes the actuation element to be pivoted relative to the outlet tube 78. The pin 98 is introduced into the slot 95, thus retracting the piston element with a tip from the outlet opening 88. A pressure is applied to the outlet element 98 via the central wall projection 96 and pins 98, which causes the valve to open via the inlet portion 90. The medium enters the outlet tube 78 with one portion of the outlet tube 78 being sealed by the piston element and the medium exiting through the outlet opening 88.

Following an actuation, the actuation element 80 resiliently returns to its initial position with the wall portions 94 push the piston element to its advanced position by means of their slot 95. The valve of the sprayer closes and the piston element is forced into the outlet opening 88.

Unlike in the embodiment depicted first, the piston element is not biased to its closed position here, but is guided by the actuation element via the dog mechanism also in this position.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed:

1. A spray discharge cap for a sprayer having a valve, comprising a spray release top attachment including a retainer ring (10; 76) and an actuation element (16; 18) which is hinged to said retainer ring, an outlet tube (26; 78) having an outlet opening (36; 88) and an inlet opening that is connected to said valve, a piston element (40) movably disposed in said outlet tube which is in a position closing said outlet opening (36; 88) if said actuation element (16; 80) is not depressed, and which is movable inside said outlet tube via a dog mechanism (64, 48; 94, 95, 98), wherein said dog mechanism interacts with said actuation element (16; 80) in such a way that if said actuation element is depressed said piston element is in a position releasing said outlet opening, characterized in that said dog mechanism of said piston has at least one pin member (48; 98) and said outlet tube has at least one recess or breakthrough (56; 92) through which said pin member projects from said outlet tube;

further characterized in that said outlet opening has an inlet portion connected to said inlet opening which opens transversely into an outlet channel (32) wherein said outlet channel has a first portion (34) connected to said outlet opening and a second portion (38) of a larger diameter;

further characterized in that said second portion (38) of said outlet channel (32) is closed by a cap member (58), and further characterized in that a spring member (54) is loaded in between said cap and said piston and forces said piston element to said position closing said outlet opening.

2. The spray discharge cap as claimed in claim 1, characterized in that said actuation element has a projection (66; 96) which, in a depressed position, bears against said outlet tube and forces it to a position opening said valve.

3. The spray discharge cap as claimed in claim 1, characterized in that said actuation element has at least one projection (64; 94) facing said outlet tube which forces the pin of the piston out of said outlet opening if said actuation element is in a depressed position.

4. The spray discharge cap as claimed in claim 1, characterized in that said inlet portion opens into said outlet channel between said first and second portions.

5. The spray discharge cap as claimed in claim 4, characterized in that said piston element (40) has a circumferential groove (46) which receives a sealing ring (52) which is sealingly disposed in said second portion.

6. The spray discharge cap as claimed in claim 1, characterized in that said outlet tube (78) is formed integrally with said retainer ring (76).

7. The spray discharge cap as claimed in claim 1, characterized in that said actuation element (80) is formed integrally with said retainer ring (76).

8. The spray discharge cap as claimed in claim 7, characterized in that said retainer ring (76) has a step (86) which holds said outlet tube (78) at one end and which has said actuation element (80) hinged thereto.

9. The spray discharge cap as claimed in claim 1, characterized in that said actuation element (80) has at least one wall portion (94) with a slot-shaped recess (95) which receives said dog mechanism of said piston and, via said wall portion, guides said piston in said outlet tube to the position closing said outlet opening and the position releasing the outlet opening.

10. The spray discharge cap as claimed in claim 1, characterized in that said dog mechanism of said piston has at least one projecting pin member (98) which projects from said outlet tube near the free end thereof.

11. A spray discharge cap for a sprayer having a valve, comprising a spray release top attachment including a retainer ring (10; 76) and an actuation element (16; 18) which is hinged to said retainer ring, an outlet tube (26; 78) having an outlet opening (36; 88) and an inlet opening that is connected to said valve, a piston element (40) movably disposed in said outlet tube which is in a position closing said outlet opening (36; 88) if said actuation element (16; 80) is not depressed, and which is movable inside said outlet tube via a dog mechanism (64, 48; 94, 95, 98), wherein said dog mechanism interacts with said actuation element (16; 80) in such a way that if said actuation element is depressed said piston element is in a position releasing said outlet opening, characterized in that said outlet opening has an inlet portion connected to said inlet opening which opens transversely into an outlet channel (32) wherein said outlet channel has a first portion (34) connected to said outlet opening and a second portion (38) of a larger diameter;

further characterized in that said second portion (38) of said outlet channel (32) is closed by a cap member (58), and further characterized in that a spring member (54) is loaded in between said cap and said piston and forces said piston element to said position closing said outlet opening.

* * * * *